US007688055B2

(12) United States Patent
Kim et al.

(10) Patent No.: US 7,688,055 B2
(45) **Date of Patent: *Mar. 30, 2010**

(54) REFERENCE VOLTAGE GENERATOR WITH LESS DEPENDENCE ON TEMPERATURE

(75) Inventors: Young-sik Kim, Gunpo-si (KR); Young-soo Sohn, Gunpo-si (KR)

(73) Assignee: Samsung Electronics Co., Ltd. (KR)

( * ) Notice: Subject to any disclaimer, the term of this patent is extended or adjusted under 35 U.S.C. 154(b) by 308 days.

This patent is subject to a terminal disclaimer.

(21) Appl. No.: 11/701,797

(22) Filed: Feb. 2, 2007

(65) Prior Publication Data

US 2007/0200543 A1 Aug. 30, 2007

(30) Foreign Application Priority Data

Feb. 25, 2006 (KR) ..... 10-2006-0018515

(51) Int. Cl.
*G05F 3/16* (2006.01)

(52) U.S. Cl. ..... 323/313; 323/314

(58) Field of Classification Search ..... 323/313, 323/314, 907

See application file for complete search history.

(56) References Cited

U.S. PATENT DOCUMENTS 4,375,596 A * 3/1983 Hoshi ..... 327/541
4,641,081 A * 2/1987 Sato et al. ..... 323/313
5,309,083 A 5/1994 Pierret et al.
5,471,131 A * 11/1995 King et al. ..... 323/314
5,559,425 A * 9/1996 Allman ..... 323/313
5,783,935 A * 7/1998 Kyung ..... 323/313
5,798,637 A * 8/1998 Kim et al. ..... 323/313
5,798,669 A * 8/1998 Klughart ..... 323/313
6,040,735 A * 3/2000 Park et al. ..... 327/541
6,548,994 B2 * 4/2003 Jang ..... 323/313
6,831,505 B2 * 12/2004 Ozoe ..... 327/541

FOREIGN PATENT DOCUMENTS

JP 5-241671 9/1993
KR 2000-0003335 1/2000
KR 10-2001-0026709 4/2001
KR 2003-0012202 2/2003

* cited by examiner

*Primary Examiner*—Bao Q Vu
*Assistant Examiner*—Jue Zhang
(74) *Attorney, Agent, or Firm*—Mills & Onello, LLP

(57) ABSTRACT

A reference voltage generator generates a reference voltage that is less dependent on temperature and can adjust the dependence of the reference voltage on temperature and the reference voltage at the same time independently of each other. The reference voltage generator including a preliminary reference voltage generation unit which generates a preliminary reference voltage which is inversely proportional to temperature and a reference voltage generation unit which generates a reference voltage by dividing the preliminary reference voltage. The reference voltage generation unit includes: at least one resistor which is connected between the preliminary reference voltage and the reference voltage; at least one transistor which is connected between the reference voltage and an internal node; and at least one second resistor which is connected between the internal node and a ground. The preliminary reference voltage or a power supply voltage is applied to at least one gate of the transistor. At least one transistor is an NMOS transistor.

15 Claims, 4 Drawing Sheets

REFERENCE VOLTAGE GENERATOR WITH LESS DEPENDENCE ON TEMPERATURE

CROSS-REFERENCE TO RELATED PATENT APPLICATION

This application claims the benefit of Korean Patent Application No. 10-2006-0018515, filed on Feb. 25, 2006, in the Korean Intellectual Property Office, the contents of which are incorporated herein in their entirety by reference.

BACKGROUND OF THE INVENTION

1. Field of the Invention

The present invention relates to a semiconductor integrated circuit, and more particularly, to a reference voltage generator which can generate a reference voltage which is less dependent on temperature.

2. Description of the Related Art

A reference voltage is a voltage which is referenced when determining a logic level of data. That is, data is compared with a reference voltage. Thereafter, if the voltage of the data is determined to be lower than the reference voltage, the data is determined as being logic low. Otherwise, the data is determined as being logic high. Therefore, when a reference voltage changes, a logic level of data which is compared with the reference voltage may not be accurately determined. In addition, a reference voltage can be used to generate an internal power supply voltage in a memory device such as a dynamic random access memory (DRAM).

A reference voltage must be uniform regardless of operating conditions, temperature variations, and power supply voltage variations. A variety of circuits for generating a reference voltage have been developed. An example of such circuits is disclosed in U.S. Pat. No. 5,309,083 A.

FIG. 1 is a circuit diagram of a conventional reference voltage generator. Referring to FIG. 1, the conventional reference voltage generator includes a preliminary reference voltage generation unit 11 which generates a preliminary reference voltage VREFP, a reference voltage generation unit 13 which generates a reference voltage VREF, and a voltage adjustment unit 15 which adjusts the preliminary reference voltage VREFP.

The preliminary reference voltage generator 11 includes a plurality of resistors $R_S$ and R11 and a plurality of NMOS transistors NM1 and NM2. The reference voltage generation unit 13 includes a resistor R21 and a plurality of NMOS transistors NM3 and NM4. The voltage adjustment unit 15 includes a PMOS transistor PM1.

The preliminary reference voltage VREFP, which is generated by the preliminary reference voltage generation unit 11, may be indicated by Equation (1):

$$\begin{aligned} VREFP &= Vtp + (Io \times R_{on}) \\ &= Vtp + \left(\frac{Vtp}{R11} \times R_{on}\right) \\ &= Vtp + \left(\frac{R_{on}}{R11} \times Vtp\right) \\ &= Vtp \times \left(1 + \frac{R_{on}}{R11}\right) \end{aligned} \tag{1}$$

where Io indicates a current flowing through the resistor R11 in the preliminary reference voltage generation unit 11, $R_{on}$ indicates the sum of the resistances of the NMOS transistors NM1 and NM2 in the preliminary reference voltage generation unit 11, and Vtp indicates a threshold voltage of the PMOS transistor PM1 of the voltage adjustment unit 15.

The reference voltage VREF, which is generated by the reference voltage generation unit 13, may be indicated by Equation (2):

$$VREF = VREFP \times \frac{R_{ton}}{R_{ton} + R21} \tag{2}$$

where $R_{ton}$ indicates the sum of the resistances of the NMOS transistors NM3 and NM4 in the reference voltage generation unit 13.

The preliminary reference voltage VREFP, which is generated by the preliminary reference voltage generation unit 11, is inversely proportional to temperature. In order to compensate for this characteristic, the reference voltage VREF, which is generated by the reference voltage generation unit 13, is designed to be proportional to temperature. As a result, the reference voltage VREF is relatively robust against temperature variations.

However, the conventional reference voltage generator cannot adequately adjust the reference voltage VREF and the dependency of the reference voltage VREF on temperature at the same time. That is, if $R_{ton}$ is set high to increase the reference voltage VREF, the dependence of the reference voltage VREF on temperature increases. On the other hand, if $R_{ton}$ is set low to lower the dependence of the reference voltage VREF on temperature, the reference voltage VREF decreases.

SUMMARY OF THE INVENTION

The present invention provides a reference voltage generator which can adjust the dependence of a reference voltage VREF on temperature and the reference voltage VREF at the same time independently of each other.

The present invention also provides a reference voltage generation unit which can generate a reference voltage which is less dependent on temperature.

According to an aspect of the present invention, there is provided a reference voltage generator including a preliminary reference voltage generation unit which generates a preliminary reference voltage which is inversely proportional to temperature, and a reference voltage generation unit which generates a reference voltage by dividing the preliminary reference voltage. The reference voltage generation unit includes at least one resistor which is connected between the preliminary reference voltage and the reference voltage, at least one transistor which is connected between the reference voltage and an internal node, and at least one second resistor which is connected between the internal node and a ground.

The preliminary reference voltage or a power supply voltage may be applied to the gate of the transistor.

The transistor may be an NMOS transistor.

In one embodiment, the preliminary reference voltage generation unit comprises: a plurality of resistors which are connected to a power supply and the internal node; and at least one transistor which is connected between the internal node and the ground. The preliminary reference voltage is output from one of a plurality of connection nodes among the resistors. In one embodiment, the preliminary reference voltage or a power supply voltage generated by the power supply is applied to the gate of the transistor. In one embodiment, the transistor is an NMOS transistor.

In one embodiment, the reference voltage generator further includes a preliminary reference voltage adjustment unit which adjusts the preliminary reference voltage in response to a control voltage generated by the preliminary reference voltage generation unit. In one embodiment, the preliminary reference voltage adjustment unit comprises a transistor which is connected between the preliminary reference voltage and the ground and is controlled by the control voltage. In one embodiment, the transistor is a PMOS transistor.

According to another aspect of the present invention, there is provided a reference voltage generator including a preliminary reference voltage generation unit which includes a plurality of resistors and at least one first transistor that are connected in series between a first power supply and a second power supply. A preliminary reference voltage is generated from one of a plurality of connection nodes among the resistors and the first transistor, and the preliminary reference voltage or a first power supply voltage generated by the first power supply is applied to the gate of the first transistor. A preliminary reference voltage adjustment unit adjusts the preliminary reference voltage in response to a control voltage output from another of the connection nodes. A first reference voltage adjuster includes at least one first resistor connected in series between the preliminary reference voltage and a reference voltage and adjusts the reference voltage. A second reference voltage adjuster includes at least one second transistor in series between the reference voltage and an internal node and adjusts the reference voltage, wherein the preliminary reference voltage or the first power supply voltage is applied to the gate of the second transistor. A third reference voltage adjuster includes at least one second resistor connected in series between the internal node and the second power supply and adjusts the reference voltage.

The preliminary reference voltage generation unit may include at least one fuse to selectively short-circuit the resistors and at least one fuse to selectively short-circuit the source and drain of the first transistor.

The first reference voltage adjuster may include at least one fuse to selectively short-circuit the first resistor.

The second reference voltage adjuster may include at least one fuse to selectively short-circuit the source and drain of the second transistor.

The third reference voltage adjuster may include at least one fuse to selectively short-circuit the second resistor.

In one embodiment, the preliminary reference voltage adjustment unit comprises a transistor which is connected between the preliminary reference voltage and the second power supply and is controlled by the control voltage.

The first power supply may be a power supply, and the second power supply is a ground.

The first transistor and the second transistor may be NMOS transistors.

In one embodiment, the transistor is a PMOS transistor.

In one embodiment, the first resistor of the first reference voltage adjuster is a PMOS transistor which is connected in series between the preliminary reference voltage and the reference voltage and has a gate to which a second power supply voltage generated by the second power supply is applied.

BRIEF DESCRIPTION OF THE DRAWINGS

The foregoing and other objects, features and advantages of the invention will be apparent from the more particular description of preferred aspects of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

The present invention will now be described more fully with reference to the accompanying drawings in which exemplary embodiments of the invention are shown.

Figure 2:
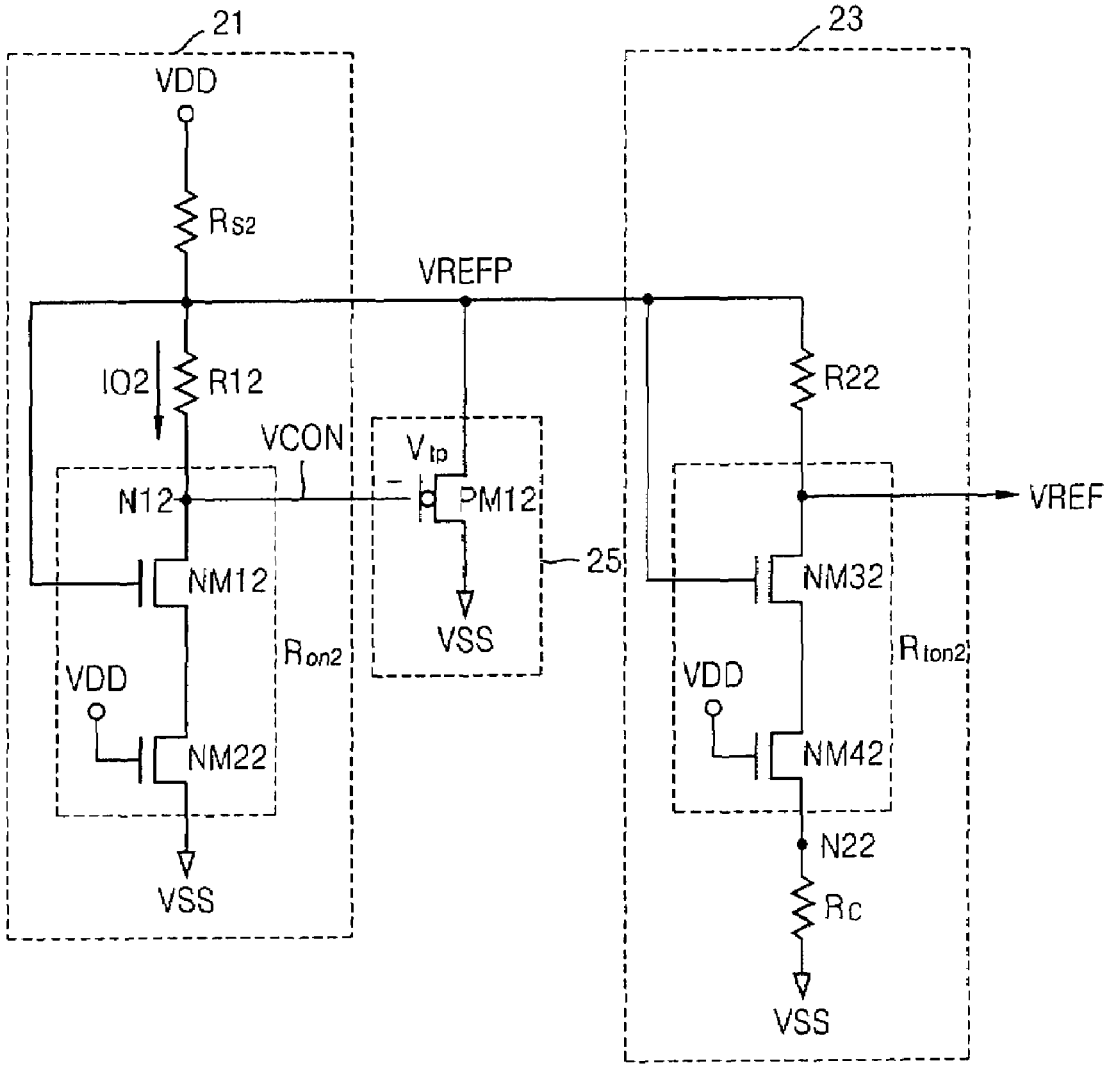
FIG. 2 is a circuit diagram of a reference voltage generator according to an exemplary embodiment of the present invention.

FIG. 2 is a circuit diagram of a reference voltage generator according to an exemplary embodiment of the present invention. Referring to FIG. 2, the reference voltage generator includes a preliminary reference voltage generation unit 21, a reference voltage generation unit 23, and a preliminary reference voltage adjustment unit 25.

The preliminary reference voltage generation unit 21 generates a preliminary reference voltage VREFP which is inversely proportional to temperature, and the reference voltage generation unit 23 generates a reference voltage VREF by dividing the preliminary reference voltage VREFP. The preliminary reference voltage adjustment unit 25 adjusts the preliminary reference voltage VREFP in response to a control voltage VCON which is generated by the preliminary reference voltage generation unit 21.

The preliminary reference voltage generation unit 21 includes: a plurality of resistors $R_{S2}$ and R12 which are connected in series between a power supply which generates a power supply voltage VDD and an internal node N12; and a plurality of transistors NM12 and NM22 which are connected between the internal node N12 and a ground which generates a ground voltage VSS. The preliminary reference voltage VREFP is applied to the gate of the transistor NM12, and the power supply voltage VDD is applied to the gate of the transistor NM22. The preliminary reference voltage generation unit 21 may include one of the transistors NM12 and NM22.

The preliminary reference voltage VREFP is output via a connection node between the resistors $R_{S2}$ and R12, and the control voltage VCON is generated from the internal node N12. The transistors NM12 and NM22 are NMOS transistors.

The preliminary reference voltage adjustment unit 25 includes a PMOS transistor PM12 which is connected between the preliminary reference voltage VREFP and the ground and is controlled by the control voltage VCON.

The reference voltage generation unit 23 includes: at least one first resistor R22 which is connected between the preliminary reference voltage VREFP and the reference voltage VREF; at least one transistor, i.e., transistors NM32 and NM42, which are connected between the reference voltage VREF and the internal node N22; and at least one second resistor which is connected between the internal node N22 and the ground VSS.

The preliminary reference voltage VREFP is applied to the gate of the transistor NM32, and the power supply voltage VDD is applied to the gate of the transistor NM42. The transistors NM32 and NM42 are NMOS transistors.

Figure 1:
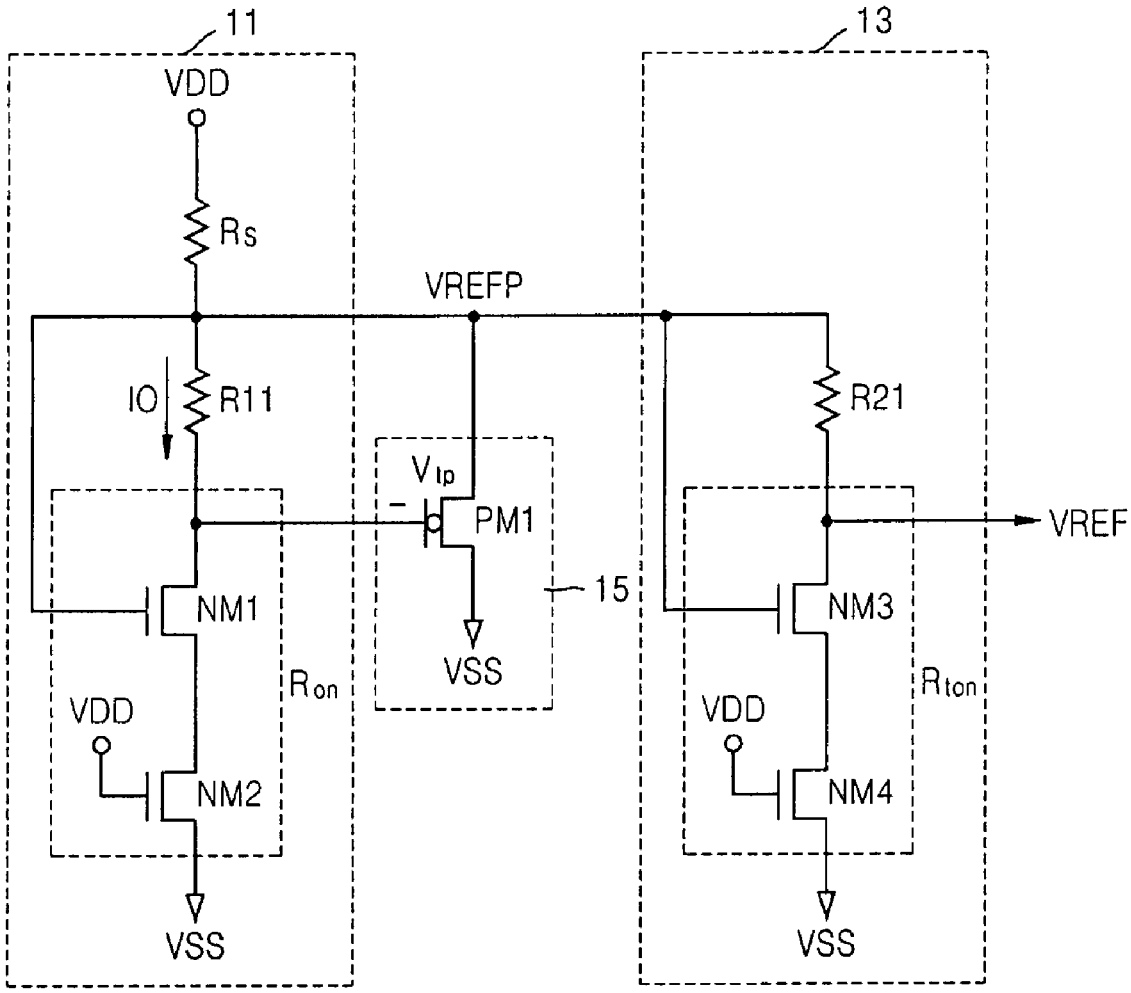
FIG. 1 (PRIOR ART)
FIG. 1 is a circuit diagram of a conventional reference voltage generator.

The reference voltage generator according to the embodiment of the present invention is different from the conventional reference voltage generator illustrated in FIG. 1 in that the reference voltage generation unit 23 includes the second resistor. The reason the second resistor is added to the reference voltage generation unit 23 will now be described in detail.

The preliminary reference voltage VREFP, which is generated by the preliminary reference voltage generation unit 21, may be indicated by Equation (3):

$$VREFP = Vtp \times \left(1 + \frac{R_{on2}}{R12}\right) \tag{3}$$

where $R_{on2}$ indicates the sum of the resistances of the NMOS transistors NM12 and NM22 in the preliminary reference voltage generation unit 21, and Vtp indicates a threshold voltage of the PMOS transistor PM12 of the preliminary reference voltage adjustment unit 25.

The reference voltage VREF, which is generated by the reference voltage generation unit 23, may be indicated by Equation (4):

$$VREF = VREFP \times \frac{R_{ton2} + R_C}{(R_{ton2} + R_C) + R22} \tag{4}$$

where $R_{ton2}$ indicates the sum of the resistances of the NMOS transistors NM32 and NM42 in the reference voltage generation unit 23, and $R_C$ indicates the resistance of the second resistor.

The preliminary reference voltage VREFP is inversely proportional to temperature, whereas $$\frac{R_{ton2} + R_C}{(R_{ton2} + R_C) + R22}$$

is proportional to temperature. Therefore, due to the interaction between the preliminary reference voltage generation unit 21 and the reference voltage generation unit 23, the reference voltage VREF becomes robust against temperature variations and is thus relatively uniform. The operating principles of this type of reference voltage generator are obvious to one of ordinary skill in the art to which the present invention pertains, and thus will not be described here in detail.

According to the current embodiment of the present invention, the reference voltage generation unit 23 includes the second resistor. Thus, the reference voltage generator can adjust the dependence of the reference voltage VREF on temperature and the reference voltage VREF at the same time independently of each other.

For example, as $R_C$ decreases and $R_{ton2}$ increases while the sum of $R_C$ and $R_{ton2}$ is uniformly maintained, a reference voltage generator becomes more dependent on temperature. On the other hand, as $R_C$ increases and $R_{ton2}$ decreases while the sum of $R_C$ and $R_{ton2}$ is uniformly maintained, a reference voltage generator becomes less dependent on temperature That is, in order to make a reference voltage generator more dependent on temperature, $R_C$ must be reduced, and $R_{ton2}$ must be increased while uniformly maintaining the sum of $R_C$ and $R_{ton2}$. On the other hand, in order to make a reference voltage generator more dependent on temperature, $R_C$ must be increased, and $R_{ton2}$ must be reduced while uniformly maintaining the sum of $R_C$ and $R_{ton2}$. The reference voltage VREF is uniformly maintained as long as the sum of $R_C$ and $R_{ton2}$ is uniformly maintained.

Figure 3:
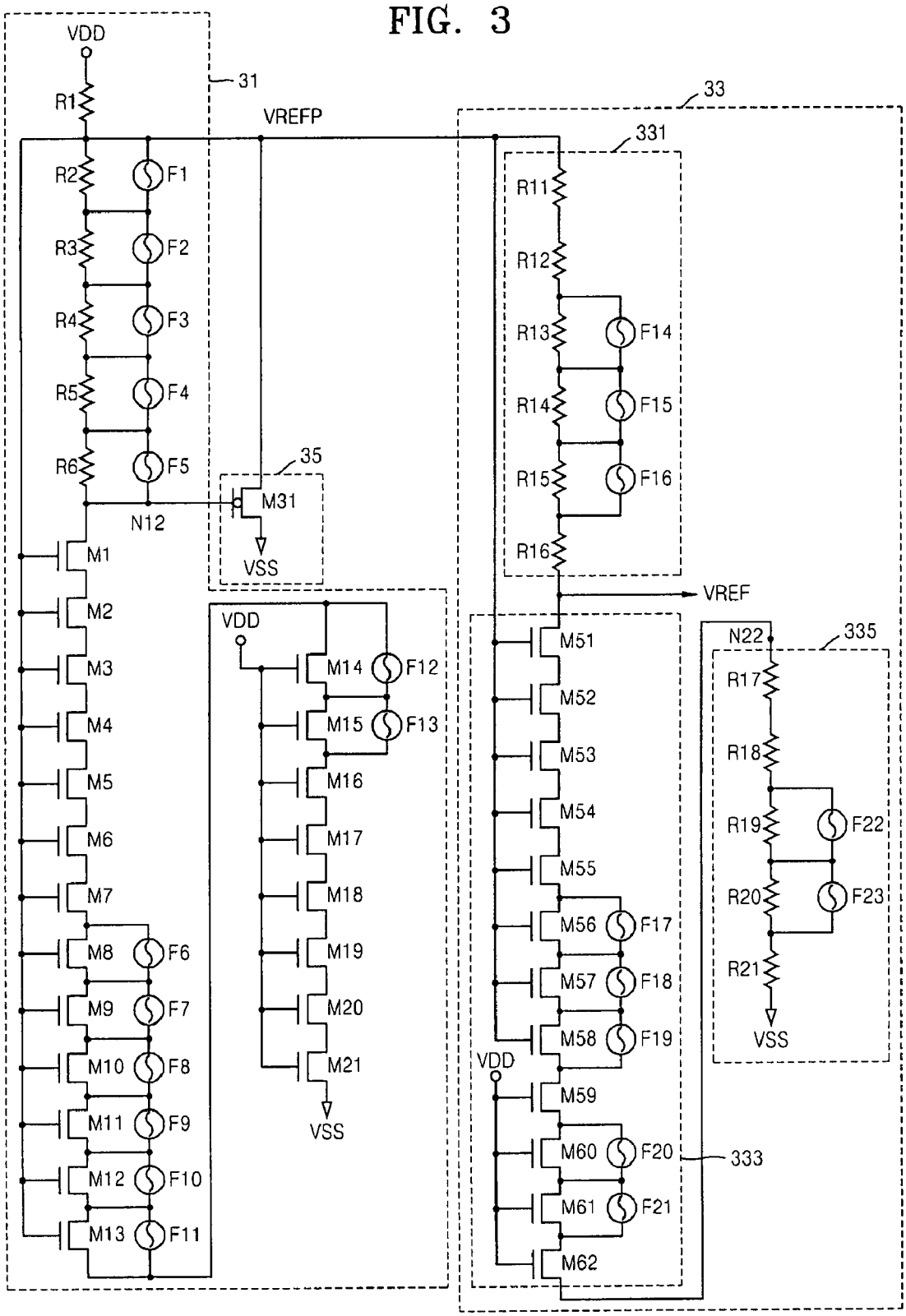
FIG. 3 is a circuit diagram of a reference voltage generator according to another exemplary embodiment of the present invention.

FIG. 3 is a circuit diagram of a reference voltage generator according to another exemplary embodiment of the present invention. Referring to FIG. 3, the reference voltage generator includes a preliminary reference voltage generation unit 31, a reference voltage generation unit 33, and a preliminary reference voltage adjustment unit 35. The preliminary reference voltage generation unit 31, the reference voltage generation unit 33, and the preliminary reference voltage adjustment unit 35 correspond to the preliminary reference voltage generation unit 21, the reference voltage generation unit 23, and the preliminary reference voltage adjustment unit 25, respectively, illustrated in FIG. 2.

A resistor R1 in the preliminary reference voltage generation unit 31 corresponds to the resistor $R_{S2}$ in the preliminary reference voltage generation unit 21 illustrated in FIG. 2. Resistors R2 through R6 in the preliminary reference voltage generation unit 31 correspond to the resistor R12 in the preliminary reference voltage generation unit 21 illustrated in FIG. 2. NMOS transistors M1 through M13 in the preliminary reference voltage generation unit 31 correspond to the NMOS transistor NM12 in the preliminary reference voltage generation unit 21 illustrated in FIG. 2. NMOS transistors M14 through M21 in the preliminary reference voltage generation unit 31 correspond to the NMOS transistor NM22 in the preliminary reference voltage generation unit 21 illustrated in FIG. 2.

The preliminary reference voltage generation unit 31 may also include at least one fuse, e.g., first through fifth fuses F1 through F5, to selectively short-circuit at least one of the resistors R2 through R6. The preliminary reference voltage generation unit 31 may also include at least one fuse, e.g., sixth through eleventh fuses F6 through F11, to selectively short-circuit the source and drain of at least one of the NMOS transistors M1 through M13. The preliminary reference voltage generation unit 31 may also include at least one fuse, e.g., twelfth and thirteenth fuses F12 and F13, to selectively short-circuit the source and drain of at least one of the NMOS transistors M14 through M21.

A PMOS transistor M31 in the preliminary reference voltage adjustment unit 35 corresponds to the PMOS transistor PM12 in the preliminary reference voltage adjustment unit 25 illustrated in FIG. 2.

The reference voltage generation unit 33 includes first, second, and third reference voltage adjusters 331, 333, and 335. Resistors R11 through R16 in the first reference voltage adjuster 331 correspond to the resistor R22 in the reference voltage generation unit 23 illustrated in FIG. 2. The first reference voltage adjuster 331 may also include at least one fuse, e.g., fourteenth through sixteenth fuses F14 through F16, to selectively short-circuit at least one of the resistors R11 through R16. The first reference voltage adjuster 331 may include a plurality of PMOS transistors which are connected in series between a preliminary reference voltage VREFP and a reference voltage VREF, wherein a ground voltage VSS is applied to the gates of the PMOS transistors.

NMOS transistors M51 through M58 in the second reference voltage adjuster 333 correspond to the NMOS transistor NM32 in the reference voltage generation unit 23 illustrated in FIG. 2. NMOS transistors M59 through M62 in the second reference voltage adjuster 333 correspond to the NMOS transistor NM42 in the reference voltage generation unit 23 illustrated in FIG. 2.

The second reference voltage adjuster 333 may also include at least one fuse, e.g., seventeenth through nineteenth fuses F17 through F19, to selectively short-circuit the source and drain of at least one of the NMOS transistors M51 through M58. In addition, the second reference voltage adjuster 333 may also include at least one fuse, i.e., twentieth and twenty first fuses, to selectively short-circuit the source and drain of at least one of the NMOS transistors M59 through M62.

Resistors R17 through R21 in the third reference voltage adjuster 335 correspond to the resistor ($R_C$) in the reference voltage generation unit 23 illustrated in FIG. 2. The third reference voltage adjuster 335 may also include at least one fuse, e.g., twenty second and twenty third fuses F22 and F23, to selectively short-circuit at least one of the resistors R17 through R21.

The structure and an operation of the reference voltage generator illustrated in FIG. 3 will now be described in detail.

The preliminary reference voltage generation unit 31 preliminarily sets the preliminary reference voltage VREFP. In detail, the preliminary reference voltage generation unit 31 sets the preliminary reference voltage VREFP by dividing a voltage with the use of the resistors R2 through R6, which is connected in series to the resistor R1, and the transistors M1 through M21.

The preliminary reference voltage adjustment unit 35 adjusts the preliminary reference voltage VREFP with the use of the PMOS transistor M31. The PMOS transistor M31 is turned on or off according to the voltage of an internal node N12 and thus reduces the preliminary reference voltage VREFP or uniformly maintains the preliminary reference voltage VREFP at an initial level set by the preliminary reference voltage generation unit 31. The voltage of the internal node N12 is determined according to whether the first through thirteenth fuses F1 through F13 in the preliminary reference voltage generation unit 31 are cut.

When the fourteenth through sixteenth fuses F14 through F16 are selectively cut, the first reference voltage adjuster 331 selectively short-circuits the resistors R13 through R15, thereby reducing the resistance of the first reference voltage adjuster 331. In this manner, the reference voltage VREF can be adjusted.

The second reference voltage adjuster 333 includes the NMOS transistors M51 through M62 which are connected in series between the reference voltage VREF and the internal node N22. The preliminary reference voltage VREFP is applied to the gates of the NMOS transistors M51 through M58, and a power supply voltage VDD is applied to the gates of the NMOS transistors M59 through M62. When the seventeenth through twenty first fuses F17 through F21 are selectively cut, the second reference voltage adjuster 333 selectively short-circuits the sources and drains of the NMOS transistors M56 through M58, M60 and M61, thereby reducing the resistance of the second reference voltage adjuster 333. In this manner, the reference voltage VREF can also be adjusted.

When the twenty second and twenty third fuses F22 and F23 are selectively cut, the third reference voltage adjuster 335 selectively short-circuits the resistors R19 and R20, thereby reducing the resistance of the third reference voltage adjuster 335. In this manner, the reference voltage VREF can also be adjusted.

The reference voltage generated by the reference voltage generator illustrated in FIG. 3 is less vulnerable to temperature variations because of the interactions between the preliminary reference voltage generation unit 31 and the first through third reference voltage adjusters 331 through 335 and is almost uniformly maintained.

In addition, the reference voltage generator illustrated in FIG. 3 can adjust the dependence of the reference voltage VREF on temperature and the reference voltage VREF at the same time with the use of the resistors R17 through R21 which are additionally installed in the third reference voltage adjuster 335.

For example, as the resistance of the third reference voltage adjuster 335, which corresponds to $R_C$ illustrated in FIG. 2, decreases and the resistance of the second reference voltage adjuster 333, which corresponds to $R_{ton2}$ illustrated in FIG. 2, increases while the sum of the resistance of the second reference voltage adjuster 333 and the resistance of the third reference voltage adjuster 335 is uniformly maintained, the reference voltage generator illustrated in FIG. 3 becomes more dependent on temperature. On the other hand, as the resistance of the third reference voltage adjuster 335 increases and the resistance of the second reference voltage adjuster 333 decreases while the sum of the resistance of the second reference voltage adjuster 333 and the resistance of the third reference voltage adjuster 335 is uniformly maintained, the reference voltage generator illustrated in FIG. 3 becomes less dependent on temperature.

The greater the number of fuses that are cut in the second reference voltage adjuster 333, the higher the resistance of the second reference voltage adjuster 333. On the other hand, the smaller the number of fuses that are cut in the second reference voltage adjuster 333, the lower the resistance of the second reference voltage adjuster 333. Likewise, the greater the number of fuses that are cut in the third reference voltage adjuster 335, the higher the resistance of the third reference voltage adjuster 335. On the other hand, the smaller the number of fuses that are cut in the third reference voltage adjuster 335, the lower the resistance of the third reference voltage adjuster 335.

Figure 4:
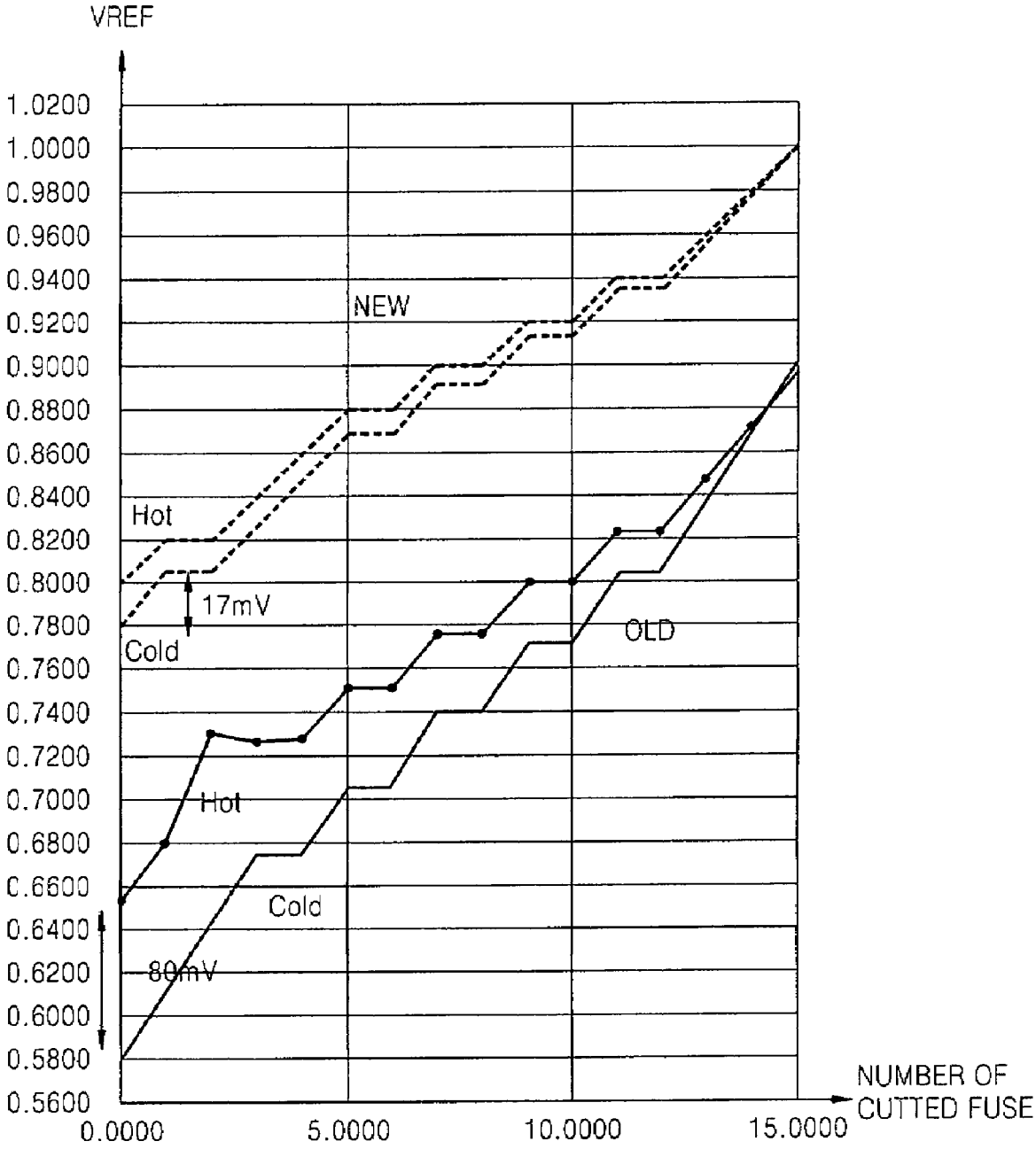
FIG. 4 is a diagram illustrating simulation results for comparing the performance of the reference voltage generator illustrated in FIG. 3 with the performance of a reference voltage generator which is obtained by redesigning the conventional reference voltage generator illustrated in FIG. 1 to have almost the same structure as the reference voltage generator illustrated in FIG. 3.

FIG. 4 is a diagram illustrating simulation results for comparing the reference voltage generator illustrated in FIG. 3 with the conventional reference voltage generator illustrated in FIG. 1. Referring to FIG. 4, the X-axis represents the number of fuses that are cut in the first reference voltage adjuster 331 illustrated in FIG. 3 and the number of fuses that are cut in a first reference voltage adjuster of the conventional reference voltage generator, and the Y-axis represents a reference voltage VREF. Reference character 'OLD' indicates simulation results obtained from the conventional reference voltage generator, reference character 'NEW' indicates simulation results obtained from the reference voltage generator illustrated in FIG. 3, reference character 'HOT' indicates simulation results obtained at a temperature of 100° C., and reference character 'COLD' indicates simulation results obtained at a temperature of 0° C.

Referring to FIG. 4, there is a difference of up to about 80 mV between a reference voltage VREF generated by the conventional reference voltage generator at a temperature of 100° C. and a reference voltage VREF generated by the conventional reference voltage generator at a temperature of 0° C. On the other hand, there is a difference of up to about 17 mV between a reference voltage VREF generated by the reference voltage generator according to the present invention at a temperature of 100° C. and a reference voltage VREF generated by the reference voltage generator according to the present invention at a temperature of 0° C. Accordingly, the reference voltages VREF generated by the reference voltage generator according to the present invention are less dependent on temperature than the reference voltage VREF generated by the conventional reference voltage generator.

The reference voltage generator according to the present invention can adjust the dependence of a reference voltage VREF on temperature and the reference voltage VREF at the same time independently of each other. The reference voltage VREF generated by the reference voltage generator according to the present invention is less dependent on temperature.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A reference voltage generator comprising:

a preliminary reference voltage generation unit which generates a preliminary reference voltage which is inversely proportional to temperature; and a reference voltage generation unit which generates a reference voltage by dividing the preliminary reference voltage, wherein the reference voltage generation unit comprises:

at least one resistor which is connected between the preliminary reference voltage and the reference voltage;

at least one transistor which is connected between the reference voltage and a first internal node; and at least one second resistor which is connected between the first internal node and a ground, wherein a sum of a first resistance of the at least one transistor and a second resistance of the at least one second resistor is uniformly maintained and the first resistance and the second resistance can be selectively changed;

Wherein the preliminary reference voltage generation unit comprises:

a plurality of resistors which are connected to a power supply and a second internal node; and at least one transistor which is connected between the second internal node and the ground, wherein the preliminary reference voltage is output from one of a plurality of connection nodes among the resistors.

2. The reference voltage generator of claim 1, wherein the preliminary reference voltage or a power supply voltage is applied to the gate of the transistor.

3. The reference voltage generator of claim 2, wherein the transistor is an NMOS transistor.

4. The reference voltage generator of claim 1, wherein the preliminary reference voltage or a power supply voltage generated by the power supply is applied to the gate of the at least one transistor of the preliminary reference voltage generation unit.

5. The reference voltage generator of claim 4, wherein the at least one transistor of the preliminary reference voltage generation unit is an NMOS transistor.

6. The reference voltage generator of claim 1, further comprising a preliminary reference voltage adjustment unit which adjusts the preliminary reference voltage in response to a control voltage generated by the preliminary reference voltage generation unit.

7. The reference voltage generator of claim 6, wherein the preliminary reference voltage adjustment unit comprises a transistor which is connected between the preliminary reference voltage and the ground and is controlled by the control voltage.

8. The reference voltage generator of claim 7, wherein the transistor of the preliminary reference voltage adjustment unit is a PMOS transistor.

9. A reference voltage generator comprising:

a preliminary reference voltage generation unit which comprises a plurality of resistors and at least one first transistor that are connected in series between a first power supply and a second power supply, wherein a preliminary reference voltage is generated from one of a plurality of connection nodes among the resistors and the first transistor, and the preliminary reference voltage or a first power supply voltage generated by the first power supply is applied to the gate of the first transistor;

a preliminary reference voltage adjustment unit which adjusts the preliminary reference voltage in response to a control voltage output from another of the connection nodes;

a first reference voltage adjuster which comprises at least one first resistor connected in series between the preliminary reference voltage and a reference voltage and adjusts the reference voltage;

a second reference voltage adjuster which comprises at least one second transistor in series between the reference voltage and an internal node and adjusts the reference voltage, wherein the preliminary reference voltage or the first power supply voltage is applied to the gate of the second transistor; and a third reference voltage adjuster which comprises at least one second resistor connected in series between the internal node and the second power supply and adjusts the reference voltage, wherein the second reference voltage adjuster comprises at least one fuse to selectively short-circuit the source and drain of the second transistor, and the third reference voltage adjuster comprises at least one fuse to selectively short-circuit the second resistor.

10. The reference voltage generator of claim 9, wherein the preliminary reference voltage generation unit comprises at least one fuse to selectively short-circuit the resistors and at least one fuse to selectively short-circuit the source and drain of the first transistor.

11. The reference voltage generator of claim 9, wherein the first reference voltage adjuster comprises at least one fuse to selectively short-circuit the first resistor.

12. The reference voltage generator of claim 9, wherein the preliminary reference voltage adjustment unit comprises a third transistor which is connected between the preliminary reference voltage and the second power supply and is controlled by the control voltage.

13. The reference voltage generator of claim 9, wherein the first power supply is a power supply, and the second power supply is a ground.

14. The reference voltage generator of claim 9, wherein the first transistor and the second transistor are NMOS transistors.

15. The reference voltage generator of claim 12, wherein the third transistor is a PMOS transistor.

* * * * *